United States Patent [19]

Phelpstead

[11] Patent Number: 4,838,286

[45] Date of Patent: Jun. 13, 1989

[54] SMOKING ARTICLES

[75] Inventor: James W. P. Phelpstead, Southampton, Great Britain

[73] Assignee: British-American Tobacco Company Limited, London, England

[21] Appl. No.: 32,984

[22] Filed: Mar. 27, 1987

Related U.S. Application Data

[63] Continuation of Ser. No. 664,591, Oct. 25, 1984, abandoned.

[30] Foreign Application Priority Data

Apr. 11, 1983 [GB] United Kingdom ..... 8329501

[51] Int. Cl.[4] ..... A24F 1/00

[52] U.S. Cl. ..... 131/360; 131/364; 131/335; 131/337; 131/339

[58] Field of Search ..... 131/77, 360, 342, 364, 131/335, 337, 339

[56] References Cited

U.S. PATENT DOCUMENTS

| | | | |
|---|---|---|---|
| 346,025 | 7/1886 | Cook | 131/360 |
| 3,972,335 | 8/1976 | Tigglebeck et al. | 131/342 |
| 4,142,534 | 3/1979 | Brantl | 131/360 |

FOREIGN PATENT DOCUMENTS

| | | |
|---|---|---|
| 4745572 | 4/1974 | Australia . |
| 2078087 | 6/1982 | United Kingdom . |

*Primary Examiner*—V. Millin

*Attorney, Agent, or Firm*—Kane, Dalsimer, Sullivan, Kurucz, Levy, Eisele and Richard

[57] ABSTRACT

In a smoking article comprising a smoking rod and a mouthpiece, the rod may comprise a wrapped body, of particles of tobacco and/or other smoking material, of which body the packing density is in a range of from 100 to 400 mg $cm^{-3}$, a passage extending within the rod and in gas-flow communication with the mouthpiece and the article comprising menthol or other vapor-release material at the mouthpiece and/or at a mouthpiece-end zone of the passage.

The passage, which may extend substantially to the mouthpiece end of the rod, may be closed at the end thereof remote the mouthpiece end.

The passage may be provided by a tube of combustible material or as a bore extending within said body of particles.

A portion of the cross-section of the mouthpiece end of the rod not occupied by said passage may be in gas-flow communication with the mouthpiece. The mouthpiece may comprise a filter.

5 Claims, 1 Drawing Sheet

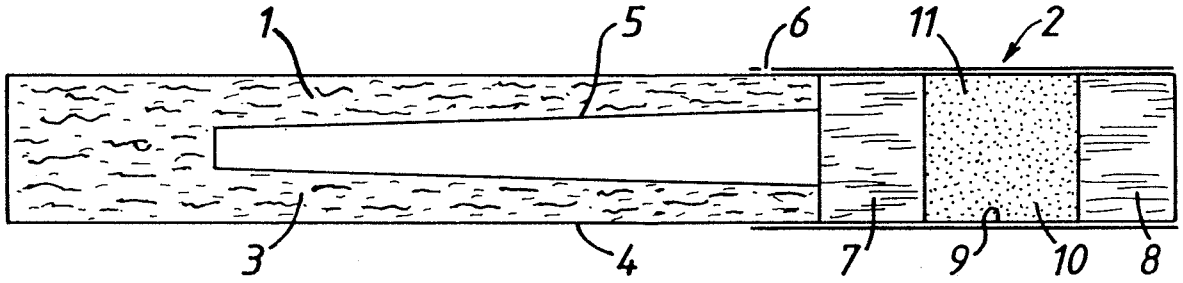
1
2
3
4
5
6
7
8
9
10
11

SMOKING ARTICLES

This application is a continuation of Ser. No. 664,591 filed 10/25/84, now abandoned.

This invention relates to smoking articles, cigarettes for example.

It has long been a practice to incorporate in cigarettes and other smoking articles flavourant materials for imparting a desired flavour to the mainstream smoke. Flavourant materials may be incorporated in the smoking material, in a wrapper of the smoking article, or in a mouthpiece or filter thereof. When a flavourant material is incorporated in a smoking article at a mouth-end region thereof, the material or a flavour-active component thereof must be volatilised by the mainstream smoke. In passing from the combustion zone to the flavourant material at the mouth-end region of a smoking article comprising an orthodox rod of particulate smoking material, the smoke must traverse the uncombusted length of the rod extending from the combustion zone. The uncombusted material of the smoking material rod acts as a heat sink, causing some smoke components to condense and the smoke to be cooled. Thus the thermal energy of the smoke available for causing volatilisation into the smoke of a flavour-active agent is significantly less than the thermal energy of the smoke upon generation at the combustion zone. The thermal energy available for volatilisation at any stage in the smoking of a smoking article determines the amount of flavour-active agent which will be volatilised into the smoke.

In U.S. Pat. No. 3,625,228 there is described a cigarette comprising a filter which houses capsules containing a fluid, the fluid preferably being an aqueous solution. Extending between the zone occupied by the capsules and the inner end of the tobacco rod of the cigarette is a baffle of a truncated conical configuration, the minor opening of the baffle being adjacent the capsule zone. When the cigarette is smoked, the mainstream smoke leaving the inner end of the tobacco rod is concentrated by the baffle into a jet which impinges on the capsules. The latter, being made of a waxlike or similar material, are caused to rupture by the warm smoke jet so that the fluid is released.

Numerous proposals have been made for providing cigarettes or cigars with one or more bores or tubes extending longitudinally within the rod of tobacco. Such cigarettes or cigars are disclosed, for example, in United Kingdom Patent Specifications Nos. 19,694/12; 225,410; 880,950; 903,572 and 1,346,116, U.S. Pat. Nos. 346,025; 2,349,551 and 3,756,249 and Canadian Patent Specification No. 687,136. In these prior art specifications the reasons for the provision of the bores or tubes include support for the tobacco ash during smoking, the introduction of air into the tobacco during smoking, satisfactory "draw" qualities, control of the amount of tobacco burnt per puff, the making possible of the use of filters of higher pressure drop and filtration efficiency; a more uniform delivery of smoke components; better tasting smoke; a more even burning of the tobacco; and a reduction of tar and nicotine levels in the smoke. Similarly constructed cigarettes and cigars are disclosed in United Kingdom Patent Specifications Nos. 232,819 and 1,086,443 and U.S. Pat. No. 3,674,036. In these specifications, the provision of a longitudinal bore or tube in the tobacco rod is said to result in a lowering of the combustion-zone temperature and thus a cooler mainstream smoke.

In none of the above-mentioned prior-art specifications concerning bores or tubes extending within tobacco rods is there a teaching that the temperature of the smoke which passes from the downstream end of the bore or tube is, in fact, much higher than that of smoke which passes from the downstream end of an orthodox tobacco rod not provided with such bore or tube. We have, however, found in our studies that whereas the temperature of smoke passing from the end of an orthodox cigarette rod has a maximum value of about 60° C., the temperature of smoke passing from a tube of combustible material extending through a cigarette rod is typically about 200° C. The temperature of the smoke may be such that when the smoke impinges on the fibres of a cellulose acetate filter, the fibres in the impingement zone would thereby be caused to fuse. The above-mentioned prior art specifications are either silent as to the elevated smoke temperature to be obtained from the use of a bore or tube, or actually teach the contrary.

The provision of a longitudinal bore or tube is a feature of some proposed smoking articles other than orthodox cigarettes or cigars, namely cigarette-simulating inhaling devices, otherwise known as cigarette substitutes. When one of these inhaling devices is "smoked", there flows from the mouth end thereof a stream of hot air or other gas which has passed, within the device, in contact with a nicotine or flavour source material. Examples of such devices are disclosed in United Kingdom Patent Specifications Nos. 1,033,674; 1,185,887 and 2 064 296A.

The present invention provides a smoking article comprising a smoking rod and a mouthpiece, said rod comprising a wrapped body of particles of tobacco and/or particles of other smoking material, the packing density of said body of particles being in a range of from 100 to 400 mg $cm^{-3}$, a passage extending within said rod and being in gas-flow communication with said mouthpiece, and said smoking article comprising vapour-release material at said mouthpiece and/or at a mouthpiece-end zone of said passage. When the smoking article is smoked, hot smoke conveyed through the passage in the smoking rod heats the vapour-release material thereby causing vapour release therefrom. A packing density range of from 150 to 400 mg $cm^{-3}$ is that employed in orthodox cigarettes. The mouthpiece may take the form of, or include, a filter. The passage within the smoking rod should extend to, or substantially to, the mouthpiece end of the rod. Suitably, the passage is closed at the other end of the rod. The passage may be provided by a tube formed of a combustible material, reconstituted tobacco for example. Alternatively, the passage may be provided as a bore extending within the body of smoking material particles. Most suitably the portion of the cross-section of the mouthpiece end of the rod which is not occupied by the passage is also in gas-flow communication with the mouthpiece.

The vapour-release material may take the form, for example, of solid granules of a material which, or a component of which, is volatilised by contact of the hot smoke. Alternatively, the vapour-release material, alone or in an aqueous or other solution, may be encapsulated in capsules or in the fibres of a fibrous material. Another alternative is for a volatilisable material to be adsorbed on a granular or fibrous carrier material. The volatilisable material may be water alone.

A cigarette in accordance with the invention is diagrammatically illustrated in the accompanying drawing. The cigarette comprises a tobacco rod 1 and a filter which is generally designated by reference numeral 2.

The tobacco rod is 64 mm long and comprises flue-cured tobacco 3, the packing density of which is about 270 mg $cm^{-3}$. The tobacco 3 is wrapped in cigarette paper 4 of an air permeability of 46 CORESTA units. Extending axially of the rod 1 from the junction thereof with the filter 2, i.e. from the downstream end, is a passage 5 of a length of about 48 mm. The passage 5 is of circular cross-section and, as is clearly shown in the drawing, it is of tapered form, the downstream end having a diameter of about 4 mm and the upstream end a diameter of about 2 mm. The walls of the passage 5 are stabilised by, for example, the application thereto of starch paste or by lining with plugwrap paper.

The filter 2, which is attached to the rod 1 by a tipping overwrap 6, comprises two spaced-apart filter plugs 7, 8 of cellulose acetate fibres. The space bounded by the plugs 7, 8 and by a pluwrap 9 of the filter 2 provides a cavity 10 in which is disposed 122 mg of magnesium silicate granules designated 11. The granules 11 are impregnated with about 7 mg of menthol.

When the cigarette and a number of identical further cigarettes were machine smoked under standard smoking conditions of a 35 $cm^3$ puff of two second duration every minute down to a tobacco rod butt length of 8 mm, it was found that the average delivery of menthol in the mainstream smoke was 0.80 mg per cigarette. Control cigarettes were identical except that the tobacco rods thereof did not have a passage 5. When the control cigarettes were smoked under the above conditions, the average menthol delivery in the mainstream smoke was found to be only 0.44 mg per cigarette. Thus the cigarettes according to the invention gave an 82% greater menthol delivery than did the control cigarettes.

When further samples of the cigarettes according to the invention were smoked by a group of expert smokers, it was noticed that the menthol taste in the mainstream smoke increased throughout the smoking of each cigarette and that there was no sensory perception of the smoke getting hotter during the smoking. When, by contrast, cigarettes of the same form, but from which the menthol-impregnated granules had been omitted, were smoked, the mainstream smoke was perceived to get continuously hotter during the smoking of each such cigarette.

I claim:

1. A smoking article comprising a smoking rod and a mouthpiece, said rod comprising a wrapped body of particles of tobacco and/or particles of other smoking material, the packing density of said body of particles being in a range of from 100 to 400 mg $cm^3$, a passage extending within said rod, said passage being in direct and unobstructed communication with said mouthpiece so as to provide a direct gas-flow communication to said mouthpiece, said passage providing for the flow of hot smoke therealong, and said smoking article comprising vapor-release material at said mouthpiece and/or at a mouthpiece-end zone of said passage, the thermal energy of said hot smoke for liberating said flavor being greater than the thermal energy available from the smoke of a conventional smoking rod.

2. A smoking article as claimed in claim 1, further comprising a tube of combustible material which defines said bore.

3. A smoking article as claimed in claim 1, in which a portion of the cross-section of the mouthpiece end of said rod not occupied by said passage is in gas-flow communication with said mouthpiece.

4. A smoking article as claimed in claim 1, in which said mouthpiece comprises a filter.

5. A smoking article as claimed in claim 1, in which said vapour-release material is capable of releasing menthol vapour.

* * * * *